US007109155B2

(12) United States Patent
Reinhardt et al.

(10) Patent No.: US 7,109,155 B2
(45) **Date of Patent: *Sep. 19, 2006**

(54) LIQUID BLEACHING COMPOSITION COMPONENTS COMPRISING AMPHIPHILIC POLYMERS

(75) Inventors: Gerd Reinhardt, Kelkheim (DE); Irina Geiger, Geinhausen-Roth (DE); Matthias Loeffler, Niedemhausen (DE); Roman Morschhaeuser, Mainz (DE)

(73) Assignee: Clariant GmbH, Frankfurt (DE)

( * ) Notice: Subject to any disclaimer, the term of this patent is extended or adjusted under 35 U.S.C. 154(b) by 185 days.

This patent is subject to a terminal disclaimer.

(21) Appl. No.: 10/727,770

(22) Filed: Dec. 4, 2003

(65) Prior Publication Data

US 2004/0167055 A1 Aug. 26, 2004

(30) Foreign Application Priority Data

Dec. 7, 2002 (DE) ..... 102 57 279

(51) Int. Cl.

| | |
|---|---|
| ***C11D 17/08*** | (2006.01) |
| ***C11D 9/42*** | (2006.01) |
| ***C11D 3/37*** | (2006.01) |
| ***C11D 3/395*** | (2006.01) |
| ***C11D 7/54*** | (2006.01) |

(52) U.S. Cl. ..... 510/302; 510/311; 510/367; 510/376; 510/475; 510/495; 510/499

(58) Field of Classification Search ..... 510/302, 510/311, 367, 376, 475, 495, 499
See application file for complete search history.

(56) References Cited

U.S. PATENT DOCUMENTS

| | | | |
|---|---|---|---|
| 3,586,715 | A | 6/1971 | Smeets |
| 3,760,986 | A | 9/1973 | Castner et al. |
| 3,822,144 | A | 7/1974 | ATaylor |
| 3,929,678 | A | 12/1975 | Laughlin et al. |
| 4,634,551 | A | 1/1987 | Burns et al. |
| 4,681,592 | A | 7/1987 | Hardy et al. |
| 4,915,863 | A | 4/1990 | Asyagi et al. |
| 4,978,770 | A | 12/1990 | Asyagi et al. |
| 5,041,232 | A | 8/1991 | Batal et al. |
| 5,045,233 | A | 9/1991 | Kita et al. |
| 5,047,163 | A | 9/1991 | Batal et al. |
| 5,194,510 | A | 3/1993 | DuBois et al. |
| 5,236,616 | A | 8/1993 | Oakes et al. |
| 5,344,581 | A | 9/1994 | Burzio et al. |
| 5,360,569 | A | 11/1994 | Madison et al. |
| 5,437,686 | A | 8/1995 | Heffner et al. |
| 5,580,485 | A | 12/1996 | Feringa et al. |
| 5,710,116 | A | 1/1998 | Miracle et al. |
| 5,739,327 | A | 4/1998 | Arbogast et al. |
| 5,785,887 | A | 7/1998 | Steltenkamp et al. |
| 6,022,490 | A | 2/2000 | Hermant et al. |
| 6,165,963 | A | 12/2000 | Delriosse et al. |
| 6,218,351 | B1 | 4/2001 | Busch et al. |
| 6,242,409 | B1 | 6/2001 | Appel et al. |
| 6,305,045 | B1 | 10/2001 | Busch et al. |
| 6,518,231 | B1 | 2/2003 | Appel et al. |
| 6,537,959 | B1 | 3/2003 | Appel et al. |
| 6,562,775 | B1 | 5/2003 | Bachmann et al. |
| 6,645,476 | B1 | 11/2003 | Morschhaeuser et al. |
| 6,649,085 | B1 | 11/2003 | Reinhardt et al. |
| 6,720,299 | B1 | 4/2004 | Chapple et al. |
| 6,818,149 | B1 | 11/2004 | Boerzel et al. |
| 2002/0122775 | A1 | 9/2002 | Reinhardt et al. |
| 2003/0017941 | A1 | 1/2003 | Busch et al. |
| 2004/0050465 | A1 | 3/2004 | Stratton |
| 2004/0058847 | A1* | 3/2004 | Morschhauser et al. .... 510/475 |
| 2004/0091444 | A1 | 5/2004 | Loeffler |
| 2004/0096409 | A1 | 5/2004 | Loeffler |
| 2004/0097657 | A1 | 5/2004 | Loeffler |
| 2004/0109835 | A1 | 6/2004 | Loeffler |
| 2004/0109836 | A1 | 6/2004 | Loeffler |
| 2004/0109838 | A1 | 6/2004 | Morschhaeuser |
| 2004/0115148 | A1 | 6/2004 | Loeffler |
| 2004/0115149 | A1 | 6/2004 | Loeffler |
| 2004/0115157 | A1 | 6/2004 | Loeffler |
| 2004/0116628 | A1 | 6/2004 | Morschhaeuser |
| 2004/0116634 | A1 | 6/2004 | Morschhaeuser |
| 2004/0141937 | A1 | 7/2004 | Loeffler |
| 2004/0167304 | A1 | 8/2004 | Morschhaeuser |

FOREIGN PATENT DOCUMENTS

| | | |
|---|---|---|
| EP | 790244 | 8/1997 |
| WO | WO 95/16023 | 6/1995 |
| WO | WO 96/37593 | 11/1996 |
| WO | WO 97/31087 | 8/1997 |
| WO | WO 01/16273 | 3/2001 |

OTHER PUBLICATIONS

Abstract for EP 790244, Aug. 20, 1997.
Abstract for WO 96/37593, Nov. 28, 1996.

* cited by examiner

*Primary Examiner*—Brian P Mruk
(74) *Attorney, Agent, or Firm*—Richard P. Silverman

(57) ABSTRACT

Liquid bleaching composition components are claimed which comprise 1) amphiphilic copolymers which include structural units which are derived from a) acryloyldimethyltauric acid in free, partially neutralized or completely neutralized form with mono- or divalent inorganic or organic cations and b) at least one hydrophobic comonomer based on ethylenically unsaturated polyalkylene alkoxylates and optionally c) further at least monovinylically unsaturated comonomers different from a) and b), and 2) at least one bleach activator, bleach catalyst or oxygen transfer agent.

8 Claims, No Drawings

LIQUID BLEACHING COMPOSITION COMPONENTS COMPRISING AMPHIPHILIC POLYMERS

The present invention relates to liquid or pasty, homogeneous and heterogeneous bleaching composition components comprising hydrophobically modified copolymers based on acryloyldimethyltauric acid. Bleaching composition components are understood as meaning organic or organometallic substances which, in combination with a peroxide source, form bleaching-active species which can be used for bleaching, oxidation, and also disinfection purposes. These include, in particular, bleach activators and bleach catalysts, and oxygen transfer agents. The finished bleaching compositions which comprise the bleaching composition components according to the invention are characterized by favorable rheological behavior, and by good compatibility with other components. They have high physical and chemical storage stability, and high hydrolysis stability of the components, in particular of the bleaching composition component and of the copolymer.

Modern liquid bleaching composition components for commercial and domestic use are subject to high requirements which are closely related to the rheology of the products: in combination with a second, peroxide-containing component, they must develop high bleaching and disinfection capacity, be application-friendly, safe, very well tolerated by the skin, but also environmentally compatible. To improve handling for the consumer and the appearance, liquid products with relatively high viscosities are entering the market to an increasing extent, meaning that thickeners and gel formers are attributed a major role. For commercial use in industrial cleaning, for paper or textile bleaching, and for surface disinfection, it is necessary for the liquid components to be pumpable and readily dosable in order to ensure simple large-scale processing.

The consistency-imparting agents used hitherto have almost exclusively been synthetic or partially synthetic polymers based on crosslinked polyacrylic acids (carbomers, carbopols), partially hydrolyzed polyacrylamides, cellulose ethers, xanthan or guar gum. In this connection, the problem of intolerance to low pH values always arises, which limit the application possibilities of many products to the neutral or slightly acidic range. A particular problem is the thickening of bleaching composition components, in particular in the case of those bleach activators which hydrolyze particularly readily in aqueous formulations to form acids and consequently allows the pH to drop into the acidic range.

Surprisingly, it has been possible to overcome this disadvantage through the use of hydrophobically modified copolymers based on acryloyldimethyltaurate, the preparation of which is described in EP 10 69 142.

By virtue of the copolymers described therein, it is possible to adjust bleaching composition formulations, as component for washing, cleaning and disinfecting, to viscosities greater than 100 cP. In particular embodiments, the formulations have an acidic to weakly alkaline character (pH<8). Happily, these formulations are additionally characterized by high UV stability. This permits the use of transparent packaging materials.

The invention provides liquid bleaching composition components comprising 1) amphiphilic copolymers which include structural units which are derived from a) acryloyldimethyltauric acid in free, partially neutralized or completely neutralized form with mono- or divalent inorganic or organic cations and b) at least one hydrophobic comonomer based on ethylenically unsaturated polyalkylene alkoxylates and optionally c) further at least monovinylically unsaturated comonomers different from a) and b), and 2) at least one bleach activator, bleach catalyst or oxygen transfer agent.

The Polymer Component

The amphiphilic copolymers preferably have a molecular weight of from $10^3$ g/mol to $10^9$ g/mol, particularly preferably from $10^4$ to $10^7$ g/mol, especially preferably $5*10^4$ to $5*10^6$ g/mol.

The acryloyldimethyltaurates (structural unit a) may be the inorganic or organic salts of acryloyldimethyltauric acid. Preference is given to the $Li^+$, $Na^+$, $K^+$, $Mg^{++}$, $Ca^{++}$, $Al^{+++}$ and/or $NH_4^+$ salts. Preference is likewise given to the monoalkylammonium, dialkylammonium, trialkylammonium and/or tetraalkylammonium salts, where the alkyl substituents of the amines may, independently of one another, be ($C_1$–$C_{22}$)-alkyl radicals which may optionally be occupied by up to 3 ($C_2$–$C_{10}$)-hydroxyalkyl groups. In addition, preference is also given to mono- to triethoxylated ammonium compounds with varying degree of ethoxylation. It should be noted that mixtures of two or more of the abovementioned representatives are also suitable.

The degree of neutralization of the acryloyldimethyltauric acid may be between 0 and 100%, particular preference being given to a degree of neutralization above 80%.

Based on the total amount of the copolymers, the content of acryloyldimethyltauric acid or acryloyldimethyltaurates may be 0.1 to 100% by weight, preferably 20 to 99.5% by weight, particularly preferably 50 to 98% by weight.

According to the invention, at least one so-called macromonomer (structural unit b) is used in the copolymerization. The macromonomers are at least monoolefinically functionalized polymers with one or more discrete repeat units and a number-average molecular weight greater than or equal to 200 g/mol. In the copolymerization, it is also possible to use mixtures of chemically different macromonomers.

Based on the total mass of the copolymers, the content of macromonomers (structural unit b) can preferably be 0.1 to 99.9% by weight, in particular 0.5 to 80% by weight, particularly preferably 2 to 50% by weight.

Preferred macromonomers b) are compounds according to formula (I)

$$R^1—Y-[(A)_v-(B)_w-(C)_x-(D)_z]—R^2 \quad (I)$$

where $R^1$ is a polymerizable function from the group of vinylically unsaturated compounds which is suitable for building up polymeric structures by free radical means. Preferably, $R^1$ is a vinyl, allyl, methallyl, methylvinyl, acrylic, methacrylic, crotonyl, senecionyl, itaconyl, maleinyl, fumaryl or styryl radical.

The joining of the polymer chain to the reactive end group requires a suitable bridging group Y. Preferred bridges Y are —O—, —C(O)—, —C(O)—O—, —S—, —O—$CH_2$—CH(O—)—$CH_2OH$, —O—$CH_2$—CH(OH)—$CH_2O$—, —O—$SO_2$—O—, —O—SO—O—, —PH—, —P($CH_3$)—, —$PO_3$—, —NH— and —N($CH_3$)—, particularly preferably —O—. The polymeric middle section of the macromonomers is represented by the discrete repeat units A, B, C and D. Preferred repeat units A, B, C and D are derived from acrylamide, methacrylamide, ethylene oxide, propylene oxide, AMPA, acrylic acid, methacrylic acid, methyl methacrylate, acrylonitrile, maleic acid, vinyl acetate, styrene, 1,3-butadiene, isoprene, isobutene, diethylacrylamide and diisopropylacrylamide, in particular from ethylene oxide and propylene oxide.

The indices v, w, x and z in formula (I) represent the stoichiometric coefficients relating to the repeat units A, B, C and D. v, w, x and z are, independently of one another 0 to 500, preferably 1 to 30, where the sum of the four coefficients must on average be ≧1.

The distribution of the repeat units over the macromonomer chain may be random, block-like, alternating or gradient-like. $R^2$ is a linear or branched aliphatic, olefinic, cycloaliphatic, arylaliphatic or aromatic ($C_1$–$C_{50}$)-hydrocarbon radical, OH, —$NH_2$, —$N(CH_3)_2$ or is the structural unit [—Y—$R^1$].

In the case of $R^2$ being [—Y—$R^1$], the macromonomers are difunctional and are suitable for crosslinking the copolymers. An example of this is the compound polyethylene glycol (molecular weight 440) diacrylate.

Particularly preferred macromonomers b) are acrylically or methacrylically monofunctionalized alkyl ethoxylates according to formula (II).

(II)

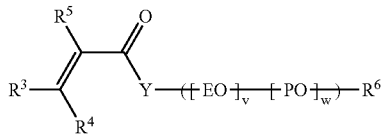

$R_3$, $R_4$, $R_5$ and $R_6$ are, independently of one another, hydrogen or n-aliphatic, isoaliphatic, olefinic, cycloaliphatic, arylaliphatic or aromatic ($C_1$–$C_{30}$)-hydrocarbon radicals.

$R_3$ and $R_4$ are preferably H or —$CH_3$, particularly preferably H; $R_5$ is H or —$CH_3$; and $R_6$ is an n-aliphatic, isoaliphatic, olefinic, cycloaliphatic, arylaliphatic or aromatic ($C_1$–$C_{30}$)-hydrocarbon radical.

v and w are in turn the stoichiometric coefficients relating to the ethylene oxide units (EO) and propylene oxide units (PO). v and w are, independently of one another, 0 to 500, preferably 1 to 30, where the sum of v and w must on average be ≧1. The distribution of the EO and PO units over the macromonomer chain may be random, block-like, alternating or gradient-like. Y is the abovementioned bridges. Preferably, Y=oxygen.

Particularly preferred macromonomers have the following structure according to formula (II), where Y in all cases is oxygen:

| Name | $R^3$ | $R^4$ | $R^5$ | $R^6$ | v | w |
|---|---|---|---|---|---|---|
| LA-030-methacrylate | H | H | —$CH_3$ | -Lauryl | 3 | 0 |
| LA-070-methacrylate | H | H | —$CH_3$ | -Lauryl | 7 | 0 |
| LA-200-methacrylate | H | H | —$CH_3$ | -Lauryl | 20 | 0 |
| LA-250-methacrylate | H | H | —$CH_3$ | -Lauryl | 25 | 0 |
| T-080-methacrylate | H | H | —$CH_3$ | -Tallow | 8 | 0 |
| T-080-acrylate | H | H | H | -Tallow | 8 | 0 |
| T-250-methacrylate | H | H | —$CH_3$ | -Tallow | 25 | 0 |
| T-250-crotonate | —$CH_3$ | H | —$CH_3$ | -Tallow | 25 | 0 |
| OC-030-methacrylate | H | H | —$CH_3$ | -Octyl | 3 | 0 |
| OC-105-methacrylate | H | H | —$CH_3$ | -Octyl | 10 | 5 |
| Behenyl-010-methacrylate | H | H | H | -Behenyl | 10 | 0 |

-continued

| Name | $R^3$ | $R^4$ | $R^5$ | $R^6$ | v | w |
|---|---|---|---|---|---|---|
| Behenyl-020-methacrylate | H | H | H | -Behenyl | 20 | 0 |
| Behenyl-010-senecionylate | —$CH_3$ | —$CH_3$ | H | -Behenyl | 10 | 0 |
| B-11-50-methacrylate | H | H | —$CH_3$ | -Butyl | 17 | 13 |
| MPEG-750-methacrylate | H | H | —$CH_3$ | -Methyl | 18 | 0 |
| P-010-acrylate | H | H | H | -Phenyl | 10 | 0 |
| O-050-acrylate | H | H | H | -Oleyl | 5 | 0 |

The molecular weight of the macromonomers b) is preferably 200 g/mol to $10^6$ g/mol, particularly preferably 150 to $10^4$ g/mol and especially preferably 200 to 5 000 g/mol.

The comonomers c) used may be all olefinically unsaturated monomers whose reaction parameters permit a copolymerization with acryloyldimethyltauric acid and/or acryloyldimethyltaurates in the particular reaction media.

Preference is given to using open-chain N-vinylamides, preferably N-vinylformamide (VIFA), N-vinylmethylformamide, N-vinylmethylacetamide (VIMA) and N-vinylacetamide; cyclic N-vinylamides (N-vinyllactams) with a ring size of from 3 to 9, preferably N-vinylpyrrolidone (NVP) and N-vinylcaprolactam; amides of acrylic acid and methacrylic acid, preferably acrylamide, methacrylamide, N,N-dimethylacrylamide, N,N-diethylacrylamide and N,N-diisopropylacrylamide; alkoxylated acrylamides and methacrylamides, preferably hydroxyethyl methacrylate, hydroxymethylmethacrylamide, hydroxyethylmethacrylamide, hydroxypropylmethacrylamide and mono-[2-(methacryloyloxy)ethyl]succinate; N,N-dimethylaminomethacrylate; diethylaminomethyl methacrylate; acryl- and methacrylamidoglycolic acid; 2- and 4-vinylpyridine; vinyl acetate; glycidyl methacrylate; styrene; acrylonitrile; stearyl acrylate; lauryl methacrylate.

In addition, one or more unsaturated carboxylic acids or salts thereof may be polymerized into the structure. Particular preference is given to acrylic acid, methacrylic acid, styrenesulfonic acid, maleic acid, fumaric acid, crotonic acid, itaconic acid and senecioic acid.

The counterions of the acids are preferably $Li^+$, $Na^+$, $K^+$, $Mg^{++}$, $Ca^{++}$, $Al^{+++}$, $NH_4^+$, monoalkylammonium, dialkylammonium, trialkylammonium and/or tetraalkylammonium radicals, where the alkyl substituents of the amines may, independently of one another be ($C_1$–$C_{22}$)-alkyl radicals, which may optionally be occupied by up to 3 ($C_2$–$C_{10}$)-hydroxyalkyl groups. In addition, mono- to triethoxylated ammonium compounds with varying degree of ethoxylation may also be used. The degree of neutralization of the carboxylic acids may be between 0 and 100%.

In a further embodiment, the copolymers according to the invention are crosslinked, i.e. they contain comonomers (structural unit c) with at least two polymerizable vinyl groups.

Preferred crosslinkers are methylenebisacrylamide; methylenebismethacrylamide; esters of unsaturated mono-polycarboxylic acids with polyols, preferably diacrylates and triacrylates or methacrylates, particularly preferably butanediol and ethylene glycol diacrylate or methacrylate, trimethylolpropane triacrylate (TMPTA) and allyl compounds, preferably allyl (meth)acrylate, triallyl cyanurate, diallyl maleate, polyallyl ester, tetraallyloxyethane, triallylamine, tetraallylethylenediamine; allyl esters of phosphoric acid; and/or vinylphosphonic acid derivatives.

Particularly preferred crosslinkers are trimethylolpropane triacrylate (TMPTA) and trimethylolpropane trimethacrylate (TMPTMA).

Mixtures of monovinylically unsaturated comonomers with polyunsaturated comonomers (crosslinkers) are of course likewise in accordance with the invention.

The proportion by weight of the comonomers (structural unit c), based on the total amount of the copolymers according to the invention, is preferably 0.01 to 90% by weight, particularly preferably 0.05 to 50% by weight and especially preferably 0.1 to 40% by weight.

The polymerization medium used may be any organic or inorganic solvents which have largely inert behavior with regard to free-radical polymerization reactions and advantageously permit the formation of moderate or high molecular weights. Preference is given to using water; lower alcohols; preferably methanol, ethanol, propanols, isobutanol, sec-butanol and t-butanol, particularly preferably t-butanol; hydrocarbons with 1 to 30 carbon atoms and mixtures of the abovementioned compounds.

The polymerization reaction preferably takes place in the temperature range between 0 and 150° C., particularly preferably between 10 and 100° C., either at atmospheric pressure or else under increased or reduced pressure. Where appropriate, the polymerization can also be carried out under a protective gas atmosphere, preferably under nitrogen.

The polymerization can be triggered using high-energy electromagnetic rays, mechanical energy or the customary chemical polymerization initiators, such as organic peroxides, e.g. benzoyl peroxide, tert.-butyl hydroperoxide, methyl ethyl ketone peroxide, cumene hydroperoxide, dilauroyl peroxide (DLP) or azo initiators, such as, for example, azodiisobutyronitrile (AIBN).

Likewise suitable are inorganic peroxy compounds, such as, for example, $(NH_4)_2S_2O_8$, $K_2S_2O_8$ or $H_2O_2$, optionally in combination with reducing agents (e.g. sodium hydrogensulfite, ascorbic acid, iron(II) sulfate etc.) or redox systems, which comprise, as reducing component, an aliphatic or aromatic sulfonic acid (e.g. benzenesulfonic acid, toluenesulfonic acid etc.).

The polymerization reaction can be carried out, for example, as precipitation polymerization, emulsion polymerization, bulk polymerization, solution polymerization or gel polymerization. For the profile of properties of the copolymers according to the invention, precipitation polymerization is particularly advantageous, preferably in tert-butanol.

The bleaching composition component

Bleaching composition component is understood as meaning bleach activators (peroxide activators), bleach catalysts and oxygen transfer agents which, in combination with a peroxide, form a bleaching-active species.

Examples of peroxides are hydrogen peroxide, in free form or as adduct (urea adduct, percarbonate), perborates, organic and inorganic peracids, such as peracetic acid and higher organic peracids or Caro's acid or salts thereof.

Peroxide activators are organic compounds comprising hydrolyzable O-acyl groups, N-acyl groups or nitrile groups.

Examples of O-acyl compounds are: carboxylic anhydrides, such as acetanhydride, nonanoic anhydride, decanoic anhydride, (substituted) succinic anhydrides, phthalic anhydrides or adipic anhydride, lactones, such as valerolactone and caprolactone, acylated polyols, such as triacetin, ethylene glycol diacetate, acetyl triethyl citrate (ATEC), 2,5-diacetoxy-2,5-dihydrofuran, acetylated sorbitol and mannitol, and mixtures thereof (SORMAN), as described in EP 525 239, acylated sugars, in particular pentaacetylglucose (PAG), pentaacetylfructose, tetraacetylxylose and octaacetyllactose.

Also suitable are acylated phenols, such as acetylphenolsulfonates, octanoyloxybenzenesulfonates, nonanoyloxybenzenesulfonates (NOBS), isononanoyloxybenzenesulfonates (ISONOBS), decanoyloxybenzenesulfonates, lauroyloxybenzenesulfonates (LOBS), benzoyloxybenzenesulfonates (BOBS), octanoyloxybenzenecarboxylic acids and nonanoyloxybenzenesulfonic acid, decanoyloxybenzenesulfonic acids (DOBA), and salts thereof, and the higher homologs with C9–C12 alkyl radicals. Also possible is the use of amidocarboxylic acid-substituted phenol derivatives as described in EP 170 386.

A further important group of bleach activators is the N-acyl compounds. Examples are acylated lactam derivatives, such as acetylcaprolactam, octanoylcaprolactam, nonanoylcaprolactam, benzoylcaprolactam, octanoylvalerolactam, nonanoylvalerolactam, acylated imides, such as N-acetylphthalimide or N-nonanoylsuccinimide (NOSI). Of particular interest are acylated amides, such as tetraacetylethylenediamine (TAED), tetraacetylglucoluril (TAGU), 1,5-diacetyl-2,4-dioxohexahydro-1,3,5-triazine (DADHT).

Examples of nitrile derivatives are described, inter alia, in Surf. Det. 34 (1997), 404–409. These include aliphatic or aromatic nitrites, such as acetonitrile, benzonitrile, 2-cyanopyridine, 3-cyanopyridine, 4-cyanopyridine, N-methyl-4-cyanopyridinium chloride, N-methyl-4-cyanopyridinium methosulfate, N-methyl-4-cyanopyridinium tosylate and N-methyl-2-cyanopyridinium chloride, cyanamide derivatives, as described in EP 0 008 475 or U.S. Pat. No. 5,478,536, such as n-cyanomorpholine, N-cyanopiperidine, N-cyanopyrrolidine or cyanamide. Suitable nitrile derivatives are also nitrile quats, as are described, inter alia, in EP 303 520 A, EP 458 396, EP 484 880, WO 96 40661 and EP 790 244.

The group of bleach catalysts includes both preprepared transition metal complexes, and also their free ligands which are able to take up corresponding metal atoms during use from the water or the soiling to be bleached and generate the complex in situ.

Corresponding complexes or ligands thereof are described, inter alia, in EP 458 379, EP 765 381, EP 902 083, EP 909 908, EP 12 25 215, WO 96/37593, WO 97/48787, WO 98/39098, WO 98/39406, WO 00/27975, WO 01/64697, WO 01/85717, WO 02/48301, WO 02/50229, WO 02/064721, WO 02/066592, U.S. Pat. No. 6,306,812, The oxygen transfer agents include, inter alia, special ketones which, in the presence of peroxide-containing compounds, form bleaching-active dioxiranes in situ.

Examples thereof are found, inter alia, in U.S. Pat. No. 3,822,144, U.S. Pat. No. 5,785,887, WO 95/31527 and EP 12 03 576 or EP 12 09 221.

The group of oxygen transfer agents further includes precursors of oxaziridines or oxaziridinium salts, as are described, for example, in U.S. Pat. No. 5,041,232, U.S. Pat. No. 5,047,163, U.S. Pat. No. 5,045,233, U.S. Pat. No. 5,360,569, U.S. Pat. No. 5,710,116, WO 01/016273. Of these, derivatives of dihydroisoquinolinium salts in particular are used in the formulations according to the invention.

Mixtures of different activators or activators with catalysts can lead to synergistic effects in the bleaching and disinfection process. Preference is given here to combinations of a hydrophilic activator with a hydrophobic activator. Examples are mixtures of TAED with NOBS, NOBS with nitrile quat or acetylcaprolactam with a cyanamide derivative. Particular preference is given to mixtures of an activator with a sulfonimine or an iminium derivative, such as TAED and N-methyldihydroisoquinolinium quat.

It is unimportant here whether the activators, catalysts or oxygen transfer agents are per se solid or liquid, water-soluble, water-miscible or solid. These compounds may, if used in solid form, either be in powder form, where the individual powder particles may be surrounded by microencapsulation or a coating layer, or be in granulated form with further components. Aqueous solutions of these compounds can comprise from 0.01% up to amounts of the solubility limit of the substance.

The bleaching composition components according to the invention can be used in washing, cleaning, disinfection and bleaching processes of every type, domestically or in the industrial sector. They are preferably used in the domestic sector as booster component for separate addition to the washing process, as a component of a two-chamber bleaching system in which peroxide source and bleach activator are initially present separately in two different chambers and, shortly prior to using the bleaching composition, are mixed or sprayed by means of corresponding apparatuses, as described, for example, in U.S. Pat. No. 3,760,986, WO 95/16023 or WO 97/31087, as one of the bleaching composition components in multicomponent washing compositions or as physically separate bleaching composition component in liquitabs (individually packaged liquid detergent).

In the industrial sector, the bleaching composition component is used, for example as a separately dosable component for commercial textile cleaning, as a separately dosable component for the disinfection of hard surfaces or as a separately dosable component for wood and paper bleaching.

The washing, cleaning, disinfection and bleaching compositions which comprise the bleaching composition components according to the invention may be in the form of aqueous, aqueous/organic, in particular aqueous/alcoholic and organic formulations. Further embodiments may be: emulsions, dispersions, gels and suspensions.

In a preferred embodiment, the bleaching composition components according to the invention comprise complexing agents in order to bind traces of heavy metals. It is possible to use the salts of polyphosphoric acids, such as 1-hydroxyethane-1,1-diphosphonic acid (HEDP) and diethylenetriaminepentamethylenephosphonic acid (DTPMP), preferably in amounts by weight of from 0.1 to 1.0% by weight. Also advantageous are acidic or alkaline additives in order to adjust the pH of the liquid component; in order to keep it constant during storage the use of buffer mixtures is useful.

The bleaching composition components according to the invention can comprise activators, catalysts or oxygen transfer agents in amounts of from 0.01 to 30% by weight, particularly preferably 0.5 to 18% by weight, in particular 1.5 to 9% by weight. In the case of the use of bleach catalysts, amounts of from 0.001 to 5% by weight may be present.

The concentration of the polymer component is, depending on the desired viscosity of the formulation according to the invention, between 0.01 and 5% by weight, preferably between 0.05 and 2% by weight. Depending on the amount of polymer used, the viscosity of the resulting gels may be between 100 and 100 000 mpas. Even at elevated storage temperatures a viscosity which is stable for months is found. The thickening of the bleaching composition component makes it easier for the user to establish the optimum dose. The solution does not splash and handling is therefore safer.

The desired viscosity of the bleaching composition component can be adjusted by adding water and/or organic solvents or by adding a combination of organic solvents and further thickeners. In principle, suitable organic solvents are all mono- or polyhydric alcohols. Preference is given to alcohols with 1 to 4 carbon atoms, such as methanol, ethanol, propanol, isopropanol, straight-chain and branched butanol, glycerol and mixtures of said alcohols. Further preferred alcohols are polyethylene glycols with a relative molecular mass below 2 000. In particular, preference is given to a use of polyethylene glycol with a relative molecular mass between 200 and 600 and in amounts up to 45% by weight and of polyethylene glycol with a relative molecular mass between 400 and 600 in amounts of from 5 to 25% by weight. The amount of water or organic solvent is generally 70 to 99% by weight.

The bleaching composition components according to the invention are usually adjusted to a pH in the range 2 to 8, preferably pH 2.1 to 7.5, particularly preferably 2.2 to 6.5.

The bleaching composition components according to the invention may also comprise, in small amounts, in each case specific auxiliaries and additives, for example acidic components, surfactants, builders, salts, optical brighteners, graying inhibitors, solubility promoters, enzymes, preservatives, fragrances and dyes, pearlizing agents, foam inhibitors, sequestrants. However, these auxiliaries and additives are preferably a constituent of washing and cleaning compositions which comprise the liquid bleaching composition components according to the invention.

Suitable acidic components are organic or inorganic acids, preferably organic acids, especially preferably alpha-hydroxyacids and acids chosen from glycolic acid, lactic acid, citric acid, tartaric acid, mandelic acid, salicylic acid, ascorbic acid, pyruvic acid, oligooxa mono- and dicarboxylic acids, fumaric acid, retinoic acid, aliphatic and organic sulfonic acids, benzoic acids, kojic acid, fruit acid, malic acid, gluconic acid, galacturonic acid.

The surfactants may be nonionic, anionic, cationic or amphoteric in nature. Preferred nonionic surfactants are fatty alcohol ethoxylates with about 1 to about 25 mol of ethylene oxide. The alkyl chain of the aliphatic alcohols may be linear or branched, primary or secondary, and generally comprises from 8 to 22 carbon atoms. Particular preference is given to the condensation products of alcohols which contain an alkyl chain of 10 to 20 carbon atoms with 2 to 18 mol of ethylene oxide per mole of alcohol. The alkyl chain may be saturated or unsaturated. The alcohol ethoxylates may likewise have a narrow homolog distribution of the ethylene oxide ("narrow range ethoxylates") or a broad homolog distribution of the ethylene oxide ("broad range ethoxylates"). Examples of commercially available nonionic surfactants of this type are Tergitol™ 15-S-9 (condensation product of a $C_{11}$–$C_{15}$ linear secondary alcohol with 9 mol of ethylene oxide), Tergitol™ 24-L-NMW (condensation product of a $C_{12}$–$C_{14}$-linear primary alcohol with 6 mol of ethylene oxide with a narrow molecular weight distribution). This class of product likewise includes the Genapol™ grades from Clariant GmbH.

Moreover, other known types of nonionic surfactants are also suitable according to the invention, such as polyethylene, polypropylene and polybutylene oxide adducts of alkylphenols with 6 to 12 carbon atoms in the alkyl chain, addition products of ethylene oxide with a hydrophobic base, formed from the condensation of propylene oxide with propylene glycol or addition products of ethylene oxide with a reaction product of propylene oxide and ethylenediamine.

It is also possible to use semipolar nonionic surfactants, for example amine oxides of the formula III

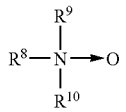

in which $R^8$ is an alkyl, hydroxyalkyl or alkylphenol group or mixtures thereof with a chain length of from 8 to 22 carbon atoms; $R^9$ is an alkylene or hydroxyalkylene group with 2 to 3 carbon atoms or mixtures thereof; $R^{10}$ is an alkyl or hydroxyalkyl group with 1 to 3 carbon atoms or a polyethylene oxide group with 1 to 3 ethylene oxide units. The $R^{10}/R^9$ groups may be joined together via an oxygen or nitrogen atom and thus form a ring. These amine oxides include, in particular $C_{10}$–$C_{18}$-alkyldimethylamine oxides and $C_8$–$C_{12}$-alkoxyethyldihydroxyethylamine oxides.

Instead of or in addition to the nonionic surfactants, the mixtures according to the invention may also comprise anionic surfactants.

Suitable anionic surfactants are primarily straight-chain and branched alkyl sulfates, alkylsulfonates, alkyl carboxylates, alkyl phosphates, alkyl ester sulfonates, arylalkylsulfonates, alkyl ether sulfates and mixtures of said compounds. Some of the suitable types of anionic surfactants will be described in more detail below.

Alkyl Ester Sulfonates

Alkyl ester sulfonates are linear esters of $C_8$–$C_{20}$-carboxylic acids (i.e. fatty acids) which are sulfonated by means of $SO_3$, as described in "The Journal of the American Oil Chemists Society", 52 (1975), pp. 323–329. Suitable starting materials are natural fat derivatives, such as, for example, tallow or palm oil fatty acid.

Alkyl Sulfates

Alkyl sulfates are water-soluble salts or acids of the formula $ROSO_3M$, in which R is preferably a $C_{10}$–$C_{24}$-hydrocarbon radical, preferably an alkyl or hydroxyalkyl radical having 10 to 20 carbon atoms, particularly preferably a $C_{12}$–$C_{18}$-alkyl or hydroxyalkyl radical. M is hydrogen or a cation, e.g. an alkali metal cation (e.g. sodium, potassium, lithium) or ammonium or substituted ammonium, e.g. a methyl-, dimethyl- and trimethylammonium cation or a quaternary ammonium cation, such as tetramethylammonium and dimethylpiperidinium cation and quaternary ammonium cations derived from alkylamines such as ethylamine, diethylamine, triethylamine and mixtures thereof. Alkyl chains with $C_{12}$–$C_{16}$ are preferred here for low washing temperatures (e.g. below about 50° C.) and alkyl chains with $C_{16}$–$C_{18}$ are preferred for higher washing temperatures (e.g. above about 50° C.).

Alkyl Ether Sulfates

The alkyl ether sulfates are water-soluble salts or acids of the formula $RO(A)_mSO_3M$, in which R is an unsubstituted $C_{10}$–$C_{24}$-alkyl or hydroxyalkyl radical having 10 to 24 carbon atoms, preferably a $C_{12}$–$C_{20}$-alkyl or hydroxyalkyl radical, particularly preferably a $C_{12}$–$C_{18}$-alkyl or hydroxyalkyl radical. A is an ethoxy or propoxy unit, m is a number greater than 0, typically between about 0.5 and about 6, particularly preferably between about 0.5 and about 3 and M is a hydrogen atom or a cation, such as, for example, a metal cation (e.g. sodium, potassium, lithium, calcium, magnesium, etc.), ammonium or a substituted ammonium cation. Examples of substituted ammonium cations are methyl, dimethyl, trimethylammonium and quaternary ammonium cations, such as tetramethylammonium and dimethylpiperidinium cations, and also those which are derived from alkylamines, such as ethylamine, diethylamine, triethylamine, mixtures thereof and the like. Examples which may be mentioned are $C_{12}$–$C_{18}$-alkyl polyethoxylate (1.0) sulfate, $C_{12}$–$C_{18}$-alkyl polyethoxylate (2.25) sulfate, $C_{12}$–$C_{18}$-alkyl polyethoxylate (3.0) sulfate, $C_{12}$–$C_{18}$-alkyl polyethoxylate (4.0) sulfate, where the cation is sodium or potassium.

Other anionic surfactants which are useful for use in washing and cleaning compositions are $C_8$–$C_{24}$-olefinsulfonates, sulfonated polycarboxylic acids prepared by sulfonation of the pyrolysis products of alkaline earth metal citrates, as described, for example, in British patent GB 1,082,179, alkylglycerol sulfates, fatty acylglycerol sulfates, oleylglycerol sulfates, alkylphenol ether sulfates, primary paraffin sulfonates, alkyl phosphates, alkyl ether phosphates, isethionates, such as acyl isethionates, N-acyltaurides, alkyl succinamates, sulfosuccinates, monoesters of sulfosuccinates (particularly saturated and unsaturated $C_{12}$–$C_{18}$-monoesters) and diesters of sulfosuccinates (particularly saturated and unsaturated $C_{12}$–$C_{18}$-diesters), acyl sarcosinates, sulfates of alkylpolysaccharides such as sulfates of alkyloylglycosides, branched primary alkyl sulfates and alkyl polyethoxycarboxylates such as those of the formula $RO(CH_2CH_2)_kCH_2COO^-M^+$, in which R is a $C_8$–$C_{22}$-alkyl, k is a number from 0 to 10 and M is a cation which forms a soluble salt. Resin acids or hydrogenated resin acids, such as rosin or hydrogenated rosin or tall oil resins and tall oil resin acids can likewise be used. Further examples are described in "Surface Active Agents and Detergents" (Vol. I and II, Schwartz, Perry and Berch). A large number of such surfactants is also claimed in U.S. Pat. No. 3,929,678.

Examples of amphoteric surfactants are primarily those which are described broadly as derivatives of aliphatic secondary and tertiary amines in which the aliphatic radical may be linear or branched and in which one of the aliphatic substituents contains between 8 and 18 carbon atoms and comprises an anionic, water-soluble group, such as, for example, carboxy, sulfonate, sulfate, phosphate or phosphonate.

Further preferred amphoteric surfactants are alkyldimethylbetaines, alkylamidobetaines and alkyldipolyethoxybetaines with an alkyl radical, which may be linear or branched, with 8 to 22 carbon atoms, preferably with 8 to 18 carbon atoms and particularly preferably with 12 to 18 carbon atoms. These compounds are marketed, for example, by Clariant GmbH under the trade name Genagen® CAB.

Suitable organic and inorganic builder substances are neutrally or, in particular, alkaline reacting salts which are able to precipitate out calcium ions or bind them to form complexes. Suitable and particularly ecologically acceptable builder substances, such as finely crystalline, synthetic hydrous zeolites of the NaA type, which have a calcium binding capacity in the range from 100 to 200 mg of CaO/g are preferably used. In nonaqueous systems, preference is given to using phyllosilicates. Zeolite and the phyllosilicates may be present in the composition in an amount up to 20% by weight. Organic builder substances which can be used are, for example, the percarboxylic acids preferably used in the form of their sodium salts, such as citric acid and nitriloacetate (NTA), ethylenediaminetetraacetic acid, provided such use is not objectionable on ecological grounds. Analogously to this, it is also possible to use polymeric carboxylates and salts thereof. These include, for example, the salts of homopolymeric or copolymeric polyacrylates, polymethacrylates and in particular copolymers of acrylic acid with maleic acid, preferably those comprising 50% to 10% of maleic acid and also polyvinylpyrrolidone and urethanes. The relative molecular mass of the homopolymers is generally between 1 000 and 100 000, that of the copolymers is between 2 000 and 200 000, preferably 50 000 to 120 000, based on the free acid, particularly suitable are also water-soluble polyacrylates which have been crosslinked, for example, with about 1% of a polyallyl ether of sucrose and which have a relative molecular mass above one million. Examples thereof are the polymers obtainable under the name Carbopol 940 and 941. The crosslinked polyacrylates are used in amounts not exceeding 1% by weight, preferably in amounts of from 0.2 to 0.7% by weight.

Examples of foam inhibitors are fatty acid alkyl ester alkoxylates, organopolysiloxanes and mixtures thereof with microfine, optionally silanized silica, and paraffins, waxes, microcrystalline waxes and mixtures thereof with silanized silica. It may also be advantageous to use mixtures of different foam inhibitors, e.g. those of silicone oil, paraffin oil or waxes. Foam inhibitors are preferably bound to a granular, water-soluble or -dispersible carrier substance.

The formulations may comprise optical brighteners, for example derivatives of diaminostilbenedisulfonic acid or alkali metal salts thereof which can be incorporated easily into the dispersion. The maximum content of brighteners in the compositions according to the invention is 0.5% by weight, preference being given to using amounts of from 0.02 to 0.25% by weight.

Suitable enzymes are those from the class of proteases, lipases, amylases, cellulases, oxidases and peroxidases or mixtures thereof. Their proportion may be 0.2 to 1% by weight. The enzymes may be adsorbed to carrier substances and/or embedded in coating substances.

Suitable preservatives are, for example, phenoxyethanol, formaldehyde solution, parabens, pentanediol or sorbic acid.

The salts or extenders used are, for example, sodium sulfate, sodium carbonate or sodium silicate (waterglass). Typical individual examples of further additives are sodium borate, starch, sucrose, polydextrose, stilbene compounds, methylcellulose, toluenesulfonate, cumenesulfonate, soaps and silicones.

The examples and applications below are intended to explain the invention in more detail, but without limiting it thereto (all the percentages given are percentages by weight).

EXAMPLES

In the examples below the following copolymers according to the invention were used:

Copolymer A
Composition
48 g of AMPA
50 g of acrylamide
2 g of PLEX 6935-O
1.8 g of TMPTA
1.2 g of DLP Copolymer B
Composition
48 g of AMPA
50 g of acrylamide
2 g of Genapol®-LA070 methacrylate
1.8 g of TMPTA
1.2 g of DLP Copolymer C
Composition
30 g of AMPA
50 g of acrylamide
20 g of MPG 750 methacrylate
1.8 g of TMPTA
1.2 g of DLP Copolymer D
Composition
30 g of AMPA
50 g of acrylamide
20 g of MPG 1500 methacrylate
1.8 g of TMPTA
1.2 g of DLP The copolymers A, B, C and D were prepared in accordance with the following general procedure:

600 g of tert-butanol were initially introduced, and AMPA, neutralized with $NH_4IG$, was added thereto. The remaining monomers were then added, the system was rendered inert with nitrogen and then DLP was added as starter. An exothermic reaction started; after this had subsided, the mixture was heated under reflux for a further 4 hours. The reaction mixture was then evaporated under reduced pressure. The polymers in each case were produced here as white powders.

| Abbreviations: | |
|---|---|
| AMPA: | acryloyldimethyltauric acid |
| PLEX 6935-O: | behenyl alcohol polyglycol ether (25 EO) methacrylate |
| Genapol-LA070-$C_{12}/C_{16}$-fatty alcohol polyglycol ether Methacrylate | (7 EO) methacrylate |
| MPG 750 methacrylate: | methanol polyglycol ether (750 EO) methacrylate |
| MPG 1500 methacrylate: | methanol polyglycol ether (1500 EO) methacrylate |
| TMPTA: | trimethylolpropane triacrylate |
| DLP: | dilauroyl peroxide |

Example 1

TAED-containing Bleaching Composition
Components

| | Formulation | | |
|---|---|---|---|
| | 1 | 2 | 3 |
| TAED powder (20–100 μm) | 5 | 10 | 20 |
| Dequest | 0.5 | 0.4 | 0.5 |
| Copolymer A | 0.07 | 0.1 | 0.3 |
| Water | ad 100 | | |
| Viscosity (CPS) | $1 \times 10^3$ | $6 \times 10^3$ | $8 \times 10^3$ |
| pH (1% strength) | 4.6 | 4.7 | 4.7 |

All three formulations are characterized by excellent physical and chemical storage stability. The active oxygen loss of TAED is less than 2% upon storage for 4 weeks at 25° C. Formulations 1 to 3 can, for example, be used in commercial laundries in order to improve the bleaching result of formulations containing hydrogen peroxide and to significantly increase the disinfection effect. In addition, such components are used for the bleaching of wood and paper, where they can replace difficult-to-handle pulverulent bleach activators.

Formulations 4 to 6

| | Formulation | | |
|---|---|---|---|
| | 4 | 5 | 6 |
| TAED powder (<10 μm) | 3 | 8 | 16 |
| Dequest 2066 ® | 0.3 | 0.3 | 0.3 |
| Copolymer B | 0.05 | 0.07 | 0.1 |
| N-Methyldihydro-isoquinolinium tosylate (U.S. Pat. No. 5,360,569) | 0.3 | 0.1 | — |
| Water | ad 100 | | |

Conventional TAED powder was initially ground down to the desired particle size in a ball mill, then introduced into the solution of Dequest and copolymer in water. The three formulations are characterized by excellent physical and chemical storage stability. The active oxygen loss is <1% upon storage for 4 weeks at 25° C. The formulations 4 to 6 can be used, for example, as a component of multichamber liquid washing compositions in which hydrogen peroxide and activator are present spatially separate during storage and are combined shortly prior to use. As a result of this, the bleaching result of the hydrogen peroxide-containing formulations is significantly improved and the disinfection effect is significantly increased.

Formulations 7 to 9

| | Formulation | | |
|---|---|---|---|
| | 7 | 8 | 9 |
| TAED powder (<10 μm) | 3 | 6 | 8 |
| Hostapur SAS ® | 2 | — | — |
| Genapol OA080 | — | 5 | 3 |
| Genapol UD 030 | — | — | 2 |
| Dequest 2066 ® | 0.3 | 0.3 | 0.5 |
| Copolymer C | 0.05 | 0.07 | 0.1 |
| Water | ad 100 | | |

Conventional TAED powder was firstly ground down to the desired particle size in a ball mill, then introduced into the solution of Dequest and copolymer in water. The three formulations are characterized by excellent physical and chemical storage stability. The active oxygen loss of TAED is <3% upon storage for 4 weeks at 25° C. Formulations 7 to 9 can be used, for example, as a component of multichamber liquid washing compositions in which hydrogen peroxide and activator are present spatially separate during storage and are combined shortly prior to use. As a result of this, the bleaching result of hydrogen peroxide-containing formulations is significantly improved and the disinfection effect is significantly increased.

Example 2

Formulation with Cyano Compounds as Bleach Activators

| | Formulation | | |
|---|---|---|---|
| | 10 | 11 | 12 |
| Cyanopiperidine | 2 | — | — |
| Cyanopyrrolidine | — | — | 3 |
| Cyanomorpholine | — | 4 | — |
| Copolymer A | 0.05 | 0.07 | — |
| Copolymer D | — | — | 0.1 |
| Water | ad 100 | | |

The three formulations are characterized by excellent physical and chemical storage stability. The active oxygen loss is <2% upon storage for 4 weeks at 40° C. The formulations 10 to 12 can be used, for example, as a component of multichamber liquid washing compositions in which hydrogen peroxide and activator are present spatially separate during storage and are combined shortly prior to use, e.g. by means of a spray nozzle. As a result of this, the bleaching result of hydrogen peroxide-containing formulations is significantly improved and the disinfection effect is significantly increased. The high viscosity of the formulation prevents the combined bleaching composition from rapidly flowing off smooth surfaces and thereby enables an extension in the contact time. In a particular embodiment, the hydrogen peroxide solution is also thickened by the addition of from 0.03 to 0.5% of the copolymer in order to establish a virtually identical viscosity in both chambers of the two-chamber container.

| Abbreviations: | |
|---|---|
| Hostapur SAS: | sec. alkanesulfonate |
| Genapol OA080: | $C_{14}/C_{15}$-oxo alcohol polyglycol ether (8 EO) |
| Genapol UD030: | $C_{11}$-oxo alcohol polyglycol ether (3 EO) |
| TAED: | tetraacetylethylenediamine |

Formulations 13 and 14

| | Formulation | |
|---|---|---|
| | 13 | 14 |
| Trimethylammonium acetonitrile methosulfate | 2 | 5 |
| Dequest 2041 ® | 0.1 | 0.2 |
| Copolymer B | 0.07 | 0.1 |
| Water | ad 100 | |

Formulations 15 to 17

| | 15 | 16 | 17 |
|---|---|---|---|
| Lauroyloxybenzenesulfonate Na | 4 | — | — |
| Decanoyloxybenzoic acid | — | 2 | — |
| Nonanoyloxybenzenesulfonate Na | — | — | 5 |

-continued

| | 15 | 16 | 17 |
|---|---|---|---|
| Dequest 2041 ® | 0.3 | 0.3 | 0.3 |
| Copolymer A | 0.1 | 0.1 | 0.07 |
| Genapol OA 080 ® | 2 | — | — |
| Water | ad 100 | | |

The invention claimed is:

1. A liquid bleaching composition component comprising 1) amphiphilic copolymers which include structural units which are derived from
   a) acryloyldimethyltauric acid in free, partially neutralized or completely neutralized form with mono- or divalent inorganic or organic cations and
   b) at least one hydrophobic comonomer based on ethylenically unsaturated polyalkylene alkoxylates and optionally
   c) further at least monovinylically unsaturated comonomers different from a) and b), and
2) at least one bleach activator, bleach catalyst or oxygen transfer agent.

2. The bleaching composition component as claimed in claim 1, in which the copolymers have a molecular weight $M_w$ of from $10^3$ g/mol to $10^9$ g/mol.

3. The bleaching composition component as claimed in claim 1, in which the acryloyldimethyltaurates (structural unit a) am selected from a salt consisting of $Li^+$, $Na^+$, $K^+$, $Mg^{++}$, $Ca^{++}$, $Al^{+++}$, monoalkylammonium, dialkylammonium, trialkylammonium tetraalkylammoniium and mixtures thereof, where alkyl substituents of the amines are, independently of one another, $(C_1–C_{22})$-alkyl radicals which may optionally be occupied by up to 3 $(C_2–C_{22})$-hydroxyalkyl groups.

4. The bleaching composition component as claimed in claim 1, in which, based on the total amount of the copolymers, the content of acryloyldimethyltauric acid or acryloyldimethyltaurates is 0.1 to 99.9% by weight.

5. The bleaching composition component as claimed in claim 1, in which the copolymer comprises, as macromonomers b), compounds according to formula (I)

$$R^1—Y-[(A)_v-(B)_w-(C)_x-(D)_z]—R^2 \quad (I)$$

in which $R^1$ is a polymerizable function from the group of vinyllcally unsaturated compounds which is suitable for building up polymeric structures by free radical means, $R^2$ is a linear or branched aliphatic, olefinic, cycloaliphatic, arylaliphatic or aromatic $(C_1–C_{50})$-hydrocarbon radical, OH, $—NH_2$, $—N(CH_3)_2$ or is the structural unit [—Y—$R^1$], Y is —O—, —C(O)—, —C(O)—O—, —S—, —O—$CH_2$—CH(O—)—$CH_2$OH, —O—$CH_2$—CH(OH) —$CH_2$O—, —O—$SO_2$—O—, —O—SO—O—, —PH—, —P($CH_3$)—, —$PO_3$—, —NH— and —N ($CH_3$), A, B, C and D are derived from the group consisting of acrylamide, methacrylamide, ethylene oxide, propylene oxide, AMPA, acrylic acid, methacrylic acid, methyl methacrylate, acrylonitrile, malelc acid, vinyl acetate, styrene, 1,3-butadiene, isoprene, isobutene, diethylacrylamide dilsopropylacrylamide and mixtures thereof, v, w, x and z, independently of one another, are numbers from 0 to 500, where the sum of the four coefficients must on average be a $\geqq 1$.

6. The bleaching composition component as claimed in claim 1, in which the molecular weight of the macromonomers b) is 200 g/mol to $10^6$ g/mol.

7. The bleaching composition component as claimed in claim 1, in which the comonomers c) are olefinically unsaturated monomers selected from the group consisting of N-vinylformamide (VIFA), N-vinylmethylformamide. N-vinylmethylacetamide (VIMA) and N-vinylacetamide; cyclic N-vinylamides (N-vinyllactams) with a ring size from 3 to 9, preferably N-vinylpyrrolidone (NVP) and N-vinylcaprolactam; amides of acrylic acid and methacrylic acid, preferably acrylamide, methacrylamide, N,N-dimethylacrylamide, N,N-diethylacrylamide and N, N-dilsopropylacrylamide; alkoxylated acrylamides and methacrylamides, preferably hydroxyethyl methacrylate, hydroxymethyl-methacrylamide, hydroxyethylmethacrylamide, hydroxypropylmethacrylamide and mono[2-(methacryloyloxy)ethyl] succinate; N, N-dimethylaminomethacrylate; diethylaminomethyl methacrylate; acryl- and methacrylamidoglycolic acid; 2- and 4-vinylpyridine; vinyl acetate; glycidyl methacrylate; styrene; acrylonitrile; stearyl acrylate; lauryl methacrylate and mixtures thereof.

8. The bleaching composition component as claimed in claim 1, comprising, as bleach activator, an organic compound with hydrolyzable O-acyl, N-acyl or nitrile groups.

* * * * *